United States Patent [19]

Pastva

[11] Patent Number: 4,601,501

[45] Date of Patent: Jul. 22, 1986

[54] DOOR CONTROL MECHANISM

[75] Inventor: John V. Pastva, Parma Heights, Ohio

[73] Assignee: The Eastern Company, Cleveland, Ohio

[21] Appl. No.: 673,675

[22] Filed: Nov. 21, 1984

[51] Int. Cl.[4] ..... E05C 9/08

[52] U.S. Cl. ..... 292/218; 292/244

[58] Field of Search ..... 292/213, 218, 244, DIG. 32, 292/148

[56] References Cited

U.S. PATENT DOCUMENTS

| | | | |
|---|---|---|---|
| 2,764,443 | 9/1956 | Bennett | 292/240 |
| 2,861,830 | 11/1958 | Bennett | 292/240 |
| 3,099,473 | 7/1963 | Pastva, Jr. | 292/240 |
| 3,134,618 | 5/1964 | Heimann | 292/218 X |
| 3,160,433 | 12/1964 | Chieger et al. | 292/241 |
| 3,212,805 | 10/1965 | Olander | 292/218 |
| 3,329,456 | 7/1967 | Olander | 292/218 |
| 3,451,705 | 6/1969 | Turpin | 292/218 |
| 3,484,127 | 12/1969 | Pastva | 292/218 |
| 3,544,145 | 12/1970 | Cerutti | 292/54 |
| 3,572,794 | 3/1971 | Pastva | 292/218 |
| 3,695,661 | 10/1972 | Pastva | 292/218 |
| 3,737,183 | 6/1973 | Pastva, Jr. | 292/218 |
| 3,756,671 | 9/1973 | White | 292/218 |
| 3,801,146 | 4/1974 | Donath et al. | 292/218 |
| 3,907,344 | 9/1975 | Newlon et al. | 292/244 |
| 3,912,312 | 10/1975 | Cerutti | 292/218 |
| 4,087,122 | 5/1978 | Shaw et al. | 292/218 |
| 4,127,291 | 11/1978 | Pelcin | 292/54 |
| 4,146,257 | 3/1979 | Pastva | 292/218 |
| 4,235,463 | 11/1980 | Benevenuta | 292/218 |
| 4,483,557 | 11/1984 | Pastva | 292/218 |

FOREIGN PATENT DOCUMENTS

| | | | |
|---|---|---|---|
| 1927476 | 12/1970 | Fed. Rep. of Germany | 292/218 |
| 2248356 | 4/1973 | Fed. Rep. of Germany . | |
| 2510554 | 10/1975 | Fed. Rep. of Germany | 292/218 |

*Primary Examiner*—Richard E. Moore

*Attorney, Agent, or Firm*—Watts, Hoffmann, Fisher & Heinke

[57] ABSTRACT

A door control mechanism for use with a pivoted door and associated frame, and a combination door, door frame and door control mechanism especially as embodied in a truck, trailer, or cargo container. The control mechanism is comprised of cam-type latches on opposite ends of a shaft rotatably connected to a pivoted door by bearing members, and keepers secured to the door frame adjacent edges of the door that are transverse to the door pivot axis. The shaft can be turned about its longitudinal axis to engage and disengage the latches and keepers. The latch on at least one end of the shaft and its keeper are of small vertical height to fit on a narrow horizontal frame member of a truck, trailer or cargo container. The latch has two oppositely extending elongated portions with sides that converge and each portion has an aperture. The keeper has a base with a tapered post receivable in the aperture of one elongated latch portion and a latch-retaining member that engages and retains the other elongated latch portion.

9 Claims, 10 Drawing Figures

DOOR CONTROL MECHANISM

TECHNICAL FIELD

This invention relates to a door control mechanism of the latch and keeper type for use with a pivoted door and frame, for example, with a door of the type used on trucks and truck trailers or on large cargo containers.

BACKGROUND ART

Load carrying compartments such as truck trailers and cargo containers typically utilize pivoted doors as one end wall to facilitate loading and unloading. A lack of cross bracing at the door opening permits some distortion of the door frame and compartment (so-called "racking") when subjected to uneven support or load-induced stresses. Door control mechanisms are used with such doors to retain the doors closed and typically include one or more lock rods extending the height of the door, a latching cam at each end of the rod or rods, and keepers on the door frame to receive the cams. Some of these mechanisms utilize latching cams with portions extending laterally on opposite sides of a lock rod to prevent racking, i.e., transverse distortion of the rectangular shape, of a truck van, truck trailer, or cargo container. Mechanisms of this type in which the latching cams are provided with forked portions that latch the door and also aid in aligning the door relative to a door frame are particularly advantageous and three such constructions are disclosed in my prior U.S. Pat. Nos. 3,099,473, 3,484,127 and 3,695,661 over which the present invention constitutes an improvement.

DISCLOSURE OF INVENTION

In accordance with this invention, a door control latch mechanism of the type that latches a door closed, forcibly aligns the door with the door frame and maintains alignment under stress is provided which, in addition, is inexpensive to manufacture, utilizes identical parts for the upper latch of both left and right side doors and, if desired, for both upper and lower latches of a door. A principal feature of the invention is the small height dimension of the cam and keeper (i.e., the vertical dimension when mounted on a horizontal door frame member of, e.g., a truck), yet the high strength sufficient to not only latch the doors but also to resist racking of the frame.

The present cam and keeper combinations are for use specifically with a narrow header, i.e., the upper horizontal frame member of a truck body, truck trailer or cargo container. Such headers are being made as narrow as possible to increase the height of the door openings without increasing the over-all height of the truck body, trailer or cargo container, to maximize the size of so-called modules or large boxes that slide into the trucks, trailers or containers for transport. The narrower headers do not readily accommodate conventional cams and keepers. Merely narrowing such conventional hardware, i.e., reducing the height, disadvantageously reduces the strength, especially the strength utilized to resist racking of the door frame.

Basically, the above-mentioned features and advantages are achieved through the present invention by constructing the cam with identical, oppositely extending, lugs, one from each side of a U-shaped body portion, rather than using a cam with fork-like ears. The U-shaped body portion receives one end of a lock rod and is welded to the rod. Opposite sides of the lugs converge and an aperture is provided in each lug that is widest adjacent the body portion and that slightly invades the wall thickness of the U-shaped body portion. The aperture has walls that converge in the direction the lugs extend and also in a direction transversely thereto. The lugs are curved so each aperture opens through a convex and concave surface and the aperture is largest at the convex surface. The associated keeper has a base portion for attachment to a door frame or the like and two spaced portions extending outward from the base portion, constructed and arranged to be engaged by the projecting lugs of the associated latch member when the lock rod is turned to a latching position. Both of the spaced extending portions have side surfaces that converge, but in opposite directions. One of the spaced extending portions of the keeper member has a latch member retaining wall extending laterally of the converging side surfaces and spaced from the base portion. The retaining wall has a convex surface facing the base, adapted to engage one lug of the associated latch member when the latch and keeper members are engaged and thereby prevent pivoting of the door. The other projecting portion is in the nature of a post, tapered outward from the base portion along the converging side surfaces. Both of the projecting latch member portions and both of the keeper lugs serve to inhibit relative shifting of the door and frame in the plane of the door when the cam and keeper are engaged.

Broadly, then, the present invention provides a cam latch and keeper combination for a door control mechanism of the type used to latch a pivoted door in a closed position, in which the latch has a body portion for attachment to a pivoted shaft and two elongated portions or lugs extending in generally opposite directions from the body portion. At least one of the elongated portions has sides that converge in a direction away from the body portion and an aperture that has sides that converge in a direction away from the body portion and in a direction transverse thereto. The keeper has a base, a tapered post projecting from the base, receivable in said aperture, and has a latch retaining member carried by the base with a latch-engaging surface spaced from and generally facing the base, to engage the other lug.

The above and other features and advantages of the present invention will become better understood from the detailed description that follows, considered in connection with the accompanying drawings.

BEST MODE FOR CARRYING OUT THE INVENTION

Figure 1:
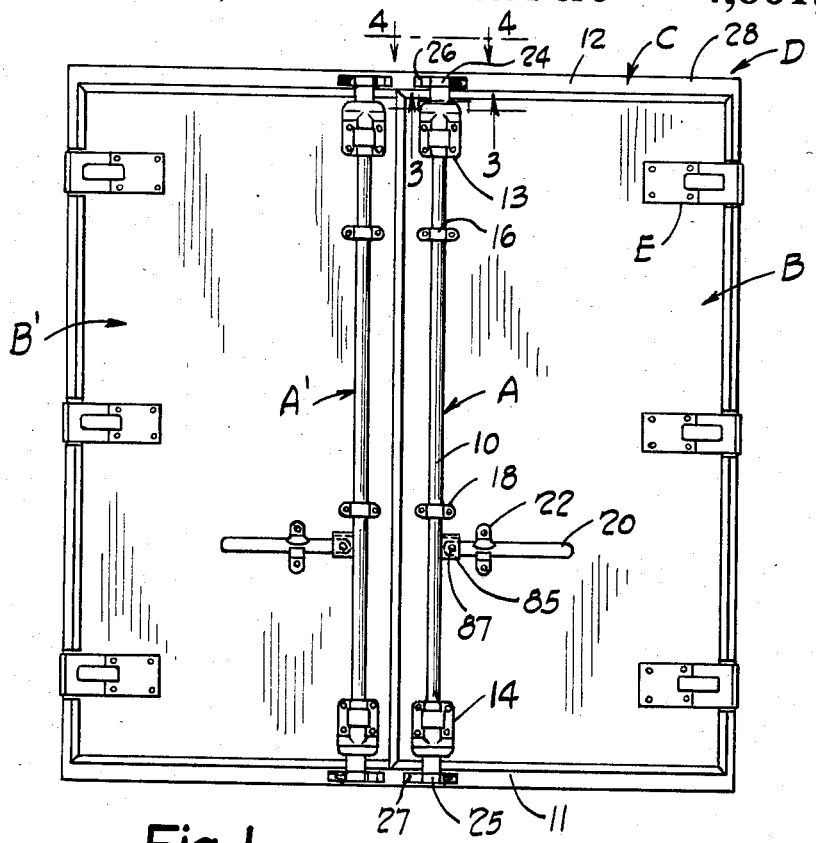
FIG. 1 is an end elevational view of the back end of a truck trailer showing a preferred embodiment of the invention.

The present invention, as embodied in a truck trailer, is illustrated in FIG. 1. As shown, a door control mechanism A is in part secured to a pivoted rear door B and in part secured to a door frame C of a truck trailer D. The door B is secured to the frame C by hinges E along the outer vertical edge. The truck trailer D, in the usual fashion, has a second rear door B′ and a second door control mechanism A′. The door control mechanism A′ is identical to the mechanism A, except that it is a mirror image. Accordingly, only the mechanism A need be described in detail.

The door control mechanism A includes a pivotable shaft or lock rod 10 that extends vertically along the outside surface of the door B from below a lower edge 11 to above an upper edge 12 of the door; upper and lower bearing members 13, 14 and intermediate bearing brackets 16, 18 that secure the lock rod 10 to the door for pivotable movement about the longitudinal axis of the rod; a handle 20 secured to and extending laterally from the rod; a handle retainer comprised of a seal plate and seal pin assembly 22 for securing the handle in a fixed position relative to the door B; upper and lower latching cams or cam members 24, 25 on opposite ends of the shaft or rod 10, located beyond the upper and lower edges of the door; and upper and lower keepers 26, 27, which are secured to the door frame C and cooperate respectively with the upper and lower latching cams to retain the door B in a closed condition and to align and maintain alignment of the door with the frame C. The lock rod 10 can be pivoted by the handle 20 to pivot the latching cams 24, 25 into and out of engagement with the keepers 26, 27.

The latching cams 24, 25 and keepers 26, 27 are identical in the arrangement shown, and only the latching cam 24 and keeper 26 will be described in detail. However, because typically only an upper frame member or header 28 in part forming the frame C will be made of reduced height to enlarge the height of the door opening formed by the frame C, the lower cam and keeper 25, 27 may be of a different structure from that of the cam and keeper 24, 26. For example, they may be of the construction shown in U.S. Pat. No. 3,695,661, which has greater height.

As best shown in FIGS. 2–5, the latching cam 24 includes a central U-shaped body portion 30 and two projecting portions or lugs 31, 32 extending from the central body portion in opposite directions. The latch or cam is symmetrical about a central plane that includes the central axis of the cam, which coincides with the central axis of the lock rod 10 when the cam is assembled to the rod. In the preferred embodiment, in which the lock rod is cylindrical in shape, the central body portion 30 of the cam is in the form of a section of a circular cylinder, open axially, forming a recess 36 that extends the length of the central body and is adapted to receive the lock rod 10. The recess 36 is at a maximum width at the axial opening. The central body portion 30 extends axially in one direction beyond the lugs to form a partial boss 37 that serves as a bearing surface. Each lug 31, 32 is identical and only the lug 31 will be described in detail. Corresponding parts of the lug 32 will be referred to by the same reference numeral for convenience.

The lug 31 has two outwardly facing sides 38, 39 that converge in a direction away from the body portion 30. The lug 31 is curved longitudinally about an axis parallel to the axis of the central body portion, so one face 40 is convex and one face 41 is concave. An aperture 44 is formed in the lug 31 and has two spaced opposed sides 45, 46 extending generally longitudinally of the lug and converging in a direction away from the body portion 30 at substantially the same angle as the outwardly facing sides 38, 39 and also converging in a direction transverse to the longitudinal extent of the lug, from the convex surface toward the concave. The aperture 44 has an end surface 47 at the body portion and a narrower end surface 48 nearer to the distal end of the lug. The end surface 47, as shown in FIG. 4, slightly invades the U-shaped body portion. The latch is assembled to the rod 10 by positioning the end of the rod within the recess 36 and welding the rod and latch together at the weld portions 49, 50 shown in FIG. 3.

The keepers 26, 27 that cooperate with the latching cams are identical to each other and only the keeper 26 will be described in detail. The keeper 26 includes a base portion 52 with a flat bottom surface 53 for placement against the frame C aligned with and directly opposite from the associated cam. The keepers are either welded to the door frame or are provided with apertures in the base to facilitate attachment with fasteners.

A tapered post 60 extends outwardly from the base portion adjacent one end and a latch-retaining member 62 extends outwardly from the base portion adjacent the other end, with a space between them suitable for receiving the central body portion 30 of the latching cam. The post 60 is constructed to be received in the aperture 44 of either one of the lugs 31, 32 (the lugs 32 in the arrangement shown in FIGS. 4 and 5) and the member 62 is constructed to receive the other of the lugs 31, 32 in a manner that retains the cam and keeper together in the absence of rotation of the lock rod 10.

Figure 4:
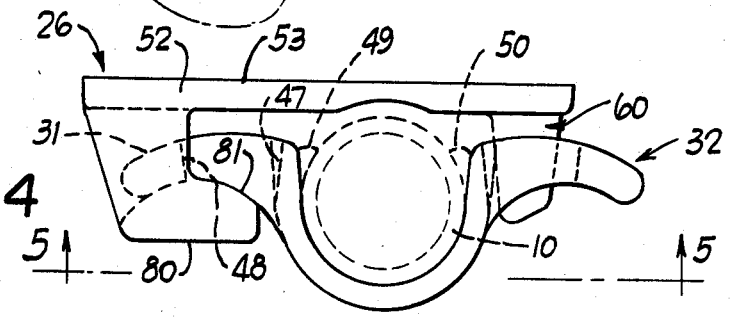
FIG. 4 is a view of the latching cam and keeper of FIG. 1 taken along the line 4—4.
Figure 5:
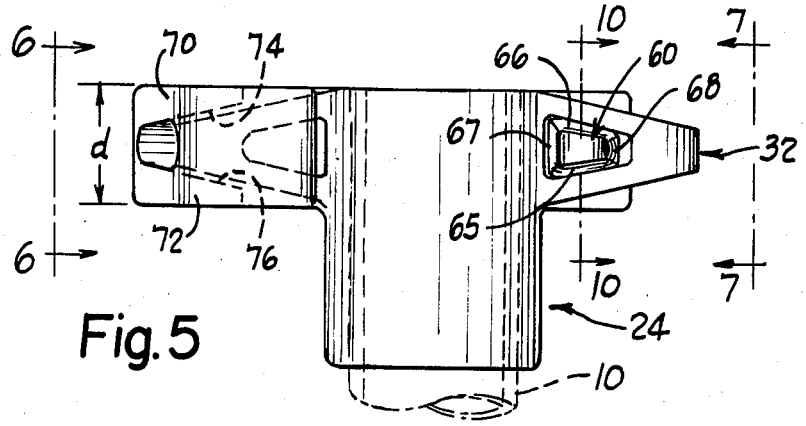
FIG. 5 is a view of the latching cam and keeper of FIG. 4 along the line 5—5.
Figure 6:
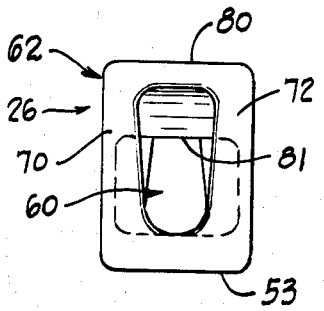
FIG. 6 is an end elevational view of the latching cam and keeper of FIG. 5 taken along the line 6—6.
Figure 7:
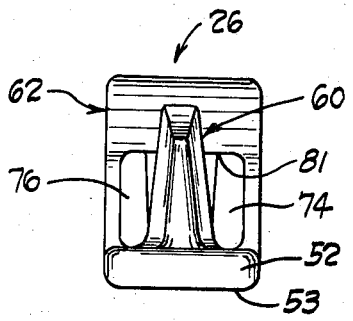
FIG. 7 is an end elevational view of the latching cam and keeper of FIG. 5 taken along the line 7—7.
Figure 8:
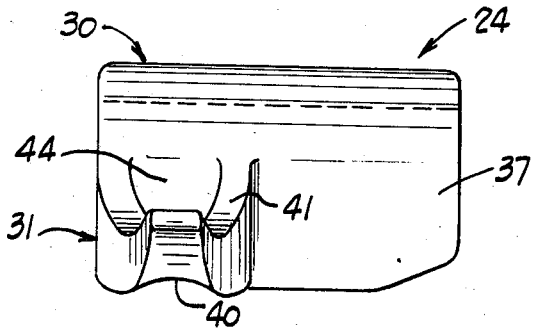
FIG. 8 is a side elevational view of the latching cam of FIG. 2 taken from the left side thereof.
Figure 9:
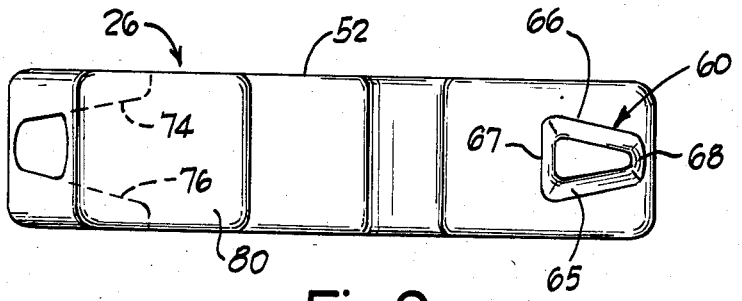
FIG. 9 is a front elevational view of the keeper of FIG. 1.
Figure 10:
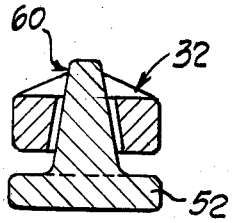
FIG. 10 is a sectional view taken along the line 10—10 of FIG. 5.

The post 60 has side surfaces 65, 66, a surface 67 that faces the member 62, and a surface 68 that faces away from the member 62. All of the surfaces 65, 66, 67, 68 converge in a direction away from the base 52 at angles relative to the plane of the base surface 53 substantially the same as the angles at which the surfaces 45, 46, 47, 48, respectively, converge. When the cam is engaged with the keeper, the cam surfaces 45, 46 engage with the post surfaces 65, 66, whereas the cam surfaces 47, 48 are spaced from the post surfaces 67, 68 as shown in FIGS. 4 and 5.

The latch-retaining member 62 has two spaced walls 70, 72 having facing surfaces 74, 76 that converge toward each other in a direction away from the post 60, and form an included angle substantially equal to the included angle between the surfaces 38, 39 of the lugs 31, 32. The distance between the wall surfaces 74, 76 closely receives one of the lugs (lug 31 in the arrangement shown in FIGS. 4 and 5). A transverse wall 80 extends between the two walls 70, 72, with a portion **80*a* cantilevered beyond the walls 70, 72 toward the post 60. The wall 80 has a convex surface 81 spaced from and facing the base 52, curved about an axis parallel to that of the body portion 30 and with a radius of curvature substantially equal to that of the surface 41** of each lug.

Figure 3:
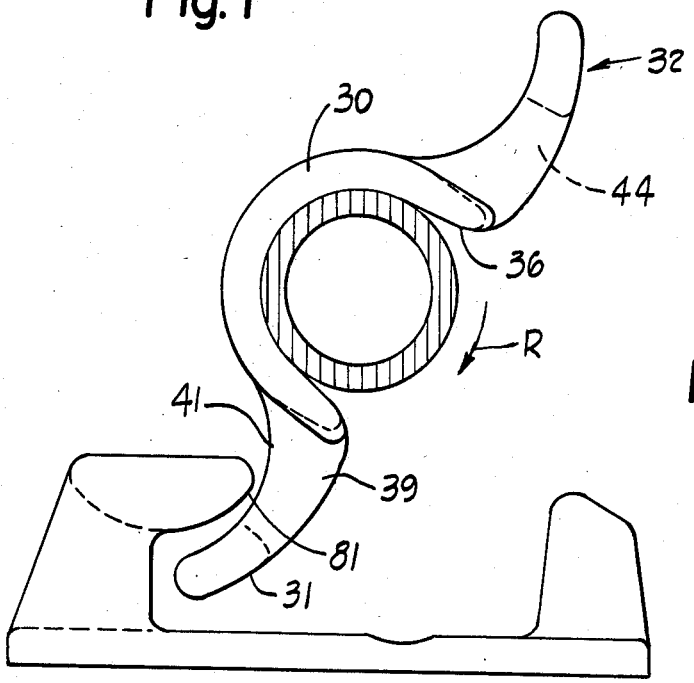
FIG. 3 is a view partially in section of a latching cam and keeper embodying the invention taken from the plane indicated by the line 3—3 of FIG. 1, but showing the cam in a position where the door is slightly ajar and in position to be cammed close.
Figure 2:
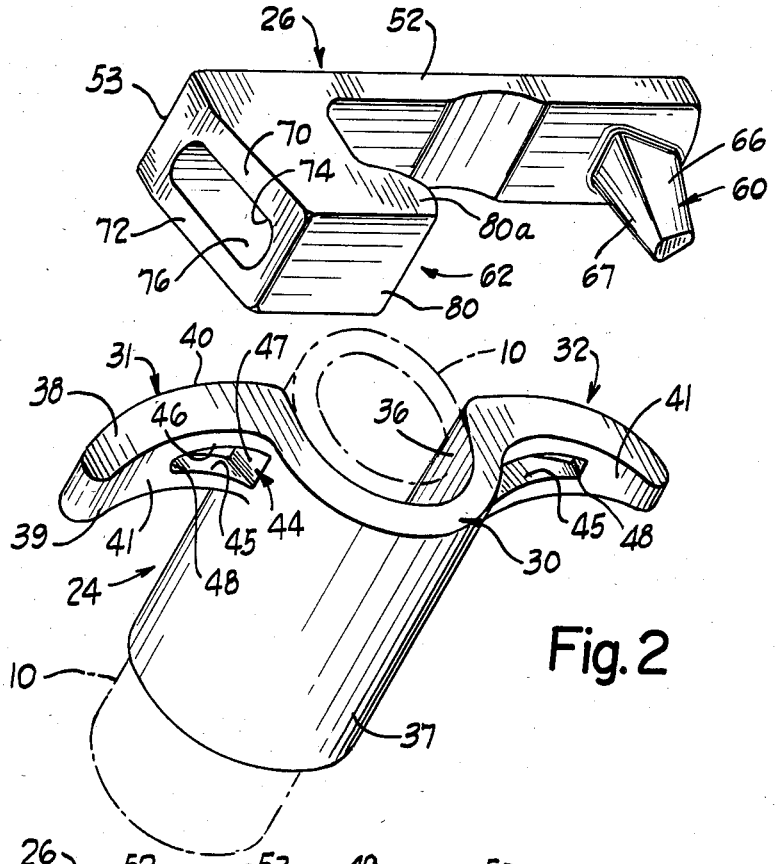
FIG. 2 is a perspective view of a latching cam and keeper embodying the invention, in spaced relationship.

The manner in which a cam 24 and keeper 26 are engaged when a door is swung closed is illustrated in FIG. 3. As the lock rod 10 is rotated in the direction of the arrow R, the concave surface 41 of the lug 31 engages the convex surface 82 of the latch-retaining member 62 and the door is cammed close, typically against the resilience of a sealing gasket between the door and door frame, as the cam and keeper are brought into the relationship shown in FIG. 4, in which the wall 80 acting on the lug 31 holds the door B tightly against the frame C. The relationship of the post 60 to the surfaces 45, 46 of the lug 32 and the relationship of the walls 70, 72 to the surfaces 38, 39 of the lug 31 tend to bring the door and frame into alignment when the door is closed and thereafter resist racking of the frame C by resisting any relative twisting between the cam and keeper about an axis perpendicular to the plane of the base 53 of the keeper. Because the lug portions on opposite sides of each aperture that either engage the post 60 or the latch-retaining member 62 are joined to the body substantially spaced apart and are also joined together at the distal end of the lugs to form a rigid triangular shape, those portions of each lug derive strength and ridigity from each other and provide adequate strength notwithstanding the small height of the lugs in the vertical dimension of a door frame, allowing the header 28 to be small in the vertical direction, yet accommodate an adequately strong cam and keeper. By merely reversing the orientation of the keeper 26, it can be located at the top of the door B′ with a cam 24 oriented identically to the cam 24 on door B. The same is true in connection with the identical cam and keeper 25, 27 at the bottom of the door B. By way of example, the dimension d (FIG. 5) of both the keeper 26 and the base of the lugs 31, 32 at the body portion 30 is approximately one inch in a preferred embodiment, whereas the corresponding dimension of the cam and keepers of a commercial embodiment of the structure disclosed in said U.S. Pat. No. 3,695,661 is approximately $1\frac{3}{4}$ inch. Yet the parts, made of the same materials, are usable on truck bodies, trailers or cargo containers of comparable size and capacity.

The upper and lower bearing members 13, 14 that support and secure the lock rod 10 to the door B are identical in construction. The bearing member 13 is located directly adjacent the upper edge 12 of the door B and the lock rod 10 extends a slight distance upward from the bearing member. The latching cam 24 secured to the end of the lock rod is closely adjacent the upper edge of the bearing member, so that the partial boss 37 of the cam or latch is supported by an upper edge of the bearing member to limit end play of the lock rod relative to the door B. The lower bearing member 14 similarly limits upward axial movement of the lock rod 10 relative to the door and the two bearing members thereby locate the rod in a substantially fixed axial position, but free to rotate or turn about its longitudinal axis.

The handle 20 is made of an elongated, flat, metal piece pivoted at one end to a handle clip 85 by a pivot pin 87 that extends through apertures in the handle clip and handle piece. The clip is U-shaped so that it extends over an upper edge of the handle piece and on two sides thereof. It is welded to the lock rod 10 so that it will transmit movement from the handle to the lock rod. A clearance is provided between the handle and clip to permit limited pivoting of the handle about the pin 87. Thus, the handle can be moved in a vertical plane a slight distance to release it from the seal plate and seal pin assembly 22, without moving the lock rod 10. Movement of the handle toward or away from the door will turn the lock rod 10 about its longitudinal axis to rotate the upper and lower latching cams 24, 25.

While a preferred embodiment of this invention has been described in detail, it will be apparent that certain modifications or alterations can be made therein without departing from the spirit and scope of the invention set forth in the appended claims.

I claim:

1. A door control mechanism of a type used to latch a pivoted door in a closed position, said mechanism comprising a keeper member adapted to be secured to a door frame adjacent an edge portion that extends transversely to the pivot axis of a pivoted door, a shaft adapted to be secured to such a door with its longitudinal axis spaced from and parallel with the pivot axis of the door, a latch member secured to an end of said shaft and cooperable with said keeper member for securing the door to which the shaft may be attached in a closed position, means for securing said shaft to the door so that the shaft can turn about its longitudinal axis, means connected to the shaft for turning it about said axis, said latch member having a U-shaped body portion partly surrounding the end of said shaft to which it is attached and portions projecting in generally opposite directions transversely of said shaft, each projecting portion having outwardly facing surfaces that converge in a direction away from said body portion and at least one projecting portion having an aperture beginning at the U-shaped body portion, elongated in the direction the projecting portion extends, said aperture being widest adjacent the U-shaped body portion and having spaced opposed walls converging in a direction away from the body portion at substantially the same angle as said outwardly facing surfaces and also converging in a transverse direction, and said keeper member having a base portion for attachment to a door frame or the like and two spaced portions extending outward from the base portion and constructed and arranged to be engaged by the projecting portions of the associated latch member when said shaft is turned to a latching position, both of said spaced extending portions having side surfaces that converge, but in opposite directions, one of said spaced extending portions of said keeper member having a latch member retaining wall extending laterally of the converging side surfaces of the said one spaced extending portion and spaced from the base portion and provided with a convex surface portion facing the base portion, adapted to engage one projecting portion of the associated latch member when the latch and keeper members are engaged and thereby prevent pivoting of the door, the other of said projecting portions being tapered outward from the base portion along said converging side surfaces, both of said projecting latch member portions and both of said keeper extending portions serving to inhibit relative shifting of the door and frame in the plane of the door when the latch member and keeper are engaged.

2. A cam latch for a door control mechanism of a type used to latch a pivoted door in a closed position, said latch comprising a body portion for attachment to a pivoted shaft and two elongated portions extending in generally opposite directions from the body portion, both of said elongated portions having sides that converge in a direction away from the body portion and an aperture having sides that converge in a direction away from the body portion.

3. A latch member as set forth in claim 2 wherein said aperture is elongated in the same direction as the elongated portion in which it is located and has one wider end directly adjacent the body portion.

4. A latch member as set forth in claim 3 wherein said elongated portions are curved so said apertures open through convex and concave surfaces and wherein the apertures are larger at the convex surface than at the concave surface.

5. A cam latch for a door control mechanism of a type used to latch a pivoted door in a closed position, said latch comprising a body portion for attachment to a pivoted shaft and two elongated portions extending in generally opposite directions from the body portion, both of said elongated portions having sides that converge in a direction away from the body portion and an aperture having sides that converge in a direction away from the body portion and in a direction transverse thereto.

6. A cam latch and keeper combination for a door control mechanism of the type used to latch a pivoted door in a closed position, said latch having a body portion for attachment to a pivoted shaft and two elongated portions extending in generally opposite directions from the body portion, both of said elongated portions having sides that converge in a direction away from the body portion and an aperture having sides that converge in a direction away from the body portion and in a direction transverse thereto; and said keeper having a base, a tapered post projecting from the base, receivable in said aperture, and a latch-retaining member carried by the base with a latch-engaging surface spaced from and generally facing the base.

7. A combination as set forth in claim 6 wherein said latch-retaining member has two spaced walls facing each other and converging in a direction away from said post, said walls having inner surfaces converging in a direction away from said base for engagement with said elongated portion having sides that converge in a direction away from the body portion and in a direction transverse thereto, and said latch engaging surface in part extends between said walls.

8. A combination as set forth in claim 7 wherein said latch-retaining member is tunnel-like in configuration, said elongated portions of the latch have a concave surface, and said latch engaging surface is convex and extends beyond said walls toward said post, said latch-retaining member being constructed for engagement of said concave and convex surfaces.

9. A cam latch and keeper combination for a door control mechanism of the type used to latch a pivoted door in a closed position, said latch having a body portion for attachment to a pivoted shaft and two elongated curved portions extending in generally opposite directions from the body portion, both of said elongated portions having sides that converge in a direction away from the body portion and an aperture having sides that converge in a direction away from the body portion and in a direction transverse thereto; and said keeper having a base, a tapered post projecting from the base, receivable in either of said apertures, and a latch-retaining member carried by the base with a convex latch-engaging surface spaced from and generally facing the base.

* * * * *